United States Patent [19]

Sadler et al.

[11] Patent Number: 4,624,721

[45] Date of Patent: Nov. 25, 1986

[54] METHOD OF USING A ROLL OF PERFORATED PLASTIC ROOFING TABS

[76] Inventors: David E. Sadler, 2025 23rd St. SW., Naples, Fla. 33999; Norman A. Walters, 662 93rd Ave. N., Naples, Fla. 33963

[21] Appl. No.: 746,135

[22] Filed: Jun. 18, 1985

[51] Int. Cl.[4] ..... B32B 7/08

[52] U.S. Cl. ..... 156/92; 428/43; 428/220; 428/906

[58] Field of Search ..... 428/43, 220, 906; 156/92

[56] References Cited

U.S. PATENT DOCUMENTS 3,326,365 6/1967 Neureither et al. ..... 428/43

4,457,964 7/1984 Kaminstein ..... 428/43

*Primary Examiner*—Alexander S. Thomas

*Attorney, Agent, or Firm*—Merrill N. Johnson

[57] ABSTRACT

A continuous roll of perforated plastic tabs for use in stapling roofing paper onto a roof or other building panel. Preferably the tabs are 1¼ inches by 1¼ inches square and 0.03 inches thick and made of styrene.

2 Claims, 4 Drawing Figures

METHOD OF USING A ROLL OF PERFORATED PLASTIC ROOFING TABS

BACKGROUND AND SUMMARY OF THE INVENTION

In the construction of residential houses and other buildings having peaked or slanted roofs, the roof, particularly in the Sunbelt regions of the United States, usually consists of three successive layers of materials. First, 4'×8' panels of ⅝" plywood are nailed to the wooden roof trusses. Next, the plywood panels are covered with overlapping horizontal strips of 36" wide builder's felt roofing paper. Finally, the roofing paper is covered by shingles of various types depending on the style of the building.

On many construction sites several weeks may elapse between the time the roofing paper is laid on the roof and when the shingles are installed. Accordingly, the roofing paper must be securely fastened to the plywood panels to prevent damage by high winds and rain not only to the roofing paper and plywood panels but to the interior of the building and its contents until the shingles are installed.

Most contractors presently engaged in roof construction use air-powered staple guns to staple roofing paper onto the underlying plywood panels, but a staple alone tends to cut through the roofing paper and thus does not provide permanent fastening of the paper to the plywood panel. Therefore, some form of reinforcement is required between the staple and the roofing paper.

The item most commonly used by roofing contractors to secure stapled paper to the plywood is a 1½" diameter tin-plated steel disc 0.015" thick. An air-driven staple will pierce this disc and secure it to the paper and underlying panel.

However, these metal discs present a number of disadvantages. To lessen rusting of the discs during storage, the discs are normally packaged in a bath of oil which makes the discs messy to work with and time-consuming and difficult to separate. If two or three unseparated discs are inadvertently placed on the felt paper and an attempt is made to staple them, the staple often will fail to penetrate the stacked discs, causing the staple gun to jam and/or possibly injure the workman.

Despite their tin-plating and oil coating, the discs often rust before they are used. The discs have a circumference which often is sharp and jagged, a source of cuts on the hands and fingers of those working daily with these discs. Finally, the air-driven staple often drives the disc into the roofing paper with such force that the sharp edge of the disc is raised up from the roofing paper a fraction of an inch, which is sufficient to expose the edge as a potentially dangerous "stumbling block" for workmen on the roof and a source of cuts on the hands and fingers of those who install the shingles or other materials after the roofing paper is laid.

We have invented a simple but unique reinforcing roofing tab for use in securing stapled roofing paper onto an underlying surface and an improved "package" for storing and delivering these tabs to the site where they are to be used.

In their preferred form, our reinforcing roofing tabs are made of styrene 0.03" thick and 1¼"×1¼" square. The tabs are manufactured, stored and delivered to the job site as a continuous roll of approximately 1100 tabs with the edges of adjacent tabs closely perforated in order to facilitate ready separation of a single tab from the roll.

The roll of perforated tabs preferably is wound upon an open hub so the roll of tabs can be hung on the belt of a workman to provide easy access to the perforated tabs as needed.

We have found that use of our perforated styrene tabs not only prevents the injuries and jammed staple guns often caused by use of the conventional metal discs, but considerable time is saved and the cost of fastening the roofing paper to the plywood panels is reduced.

DETAILED DESCRIPTION OF THE INVENTION

Figure 1:
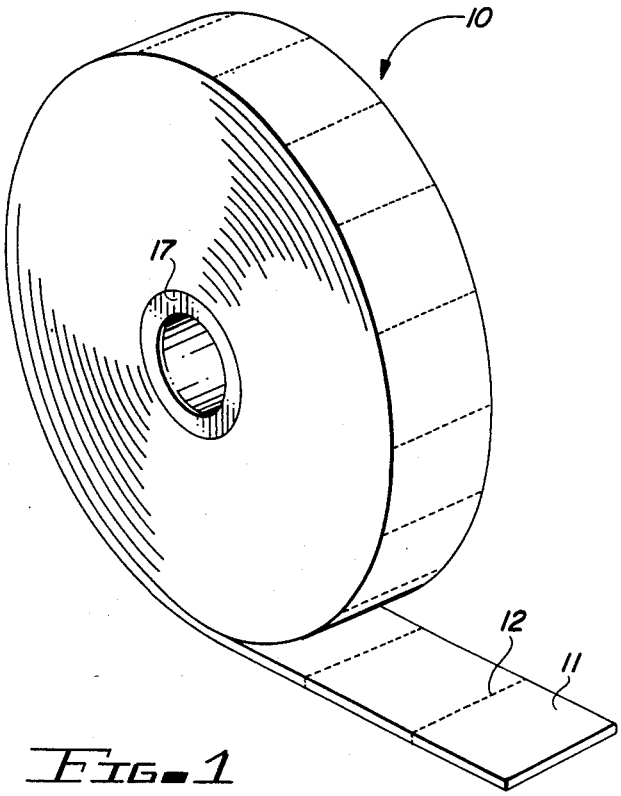
FIG. 1 is a perspective view of a roll of our perforated reinforcing roofing tabs.
Figure 2:
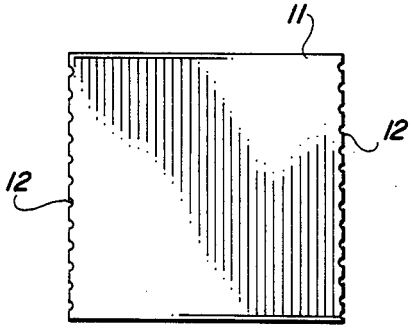
FIG. 2 is a plan view of one of our roofing tabs.

Referring to FIGS. 1 and 2 of the attached drawings, tab 11 is made of a plastic material such as styrene preferably 0.030 inches thick and 1¼ inches by 1¼ inches square. Two opposing sides 12 of each tab 11 are closely perforated to permit quick and easy separation of an individual tab from its adjacent tab.

For convenience in the manufacture, marketing and storage of a supply of tabs 12, a continuous strip of perforated tabs 11 is wound into a roll 10 of preferably 1100 tabs around a hollow cylindrical core 17 shown in FIG. 1. If desired, a thin coating of pressure sensitive adhesive may be applied to the upper surface of the strip of tabs 11 during manufacture to prevent undesired separation of roll 10 prior to use of the tabs.

A roll of perforated tabs such as roll 10 provides a convenient "package" of tabs which can be hung from the belt or otherwise made readily accessible to a workman using a staple gun to secure roofing paper to the panels of a roof or other structure.

Figure 4:
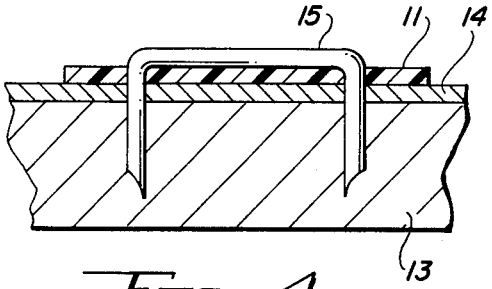
FIG. 4 is a detailed cross-sectional view of a strip of roofing paper stapled to a plywood panel using one of our perforated reinforcing roofing tabs.
Figure 3:
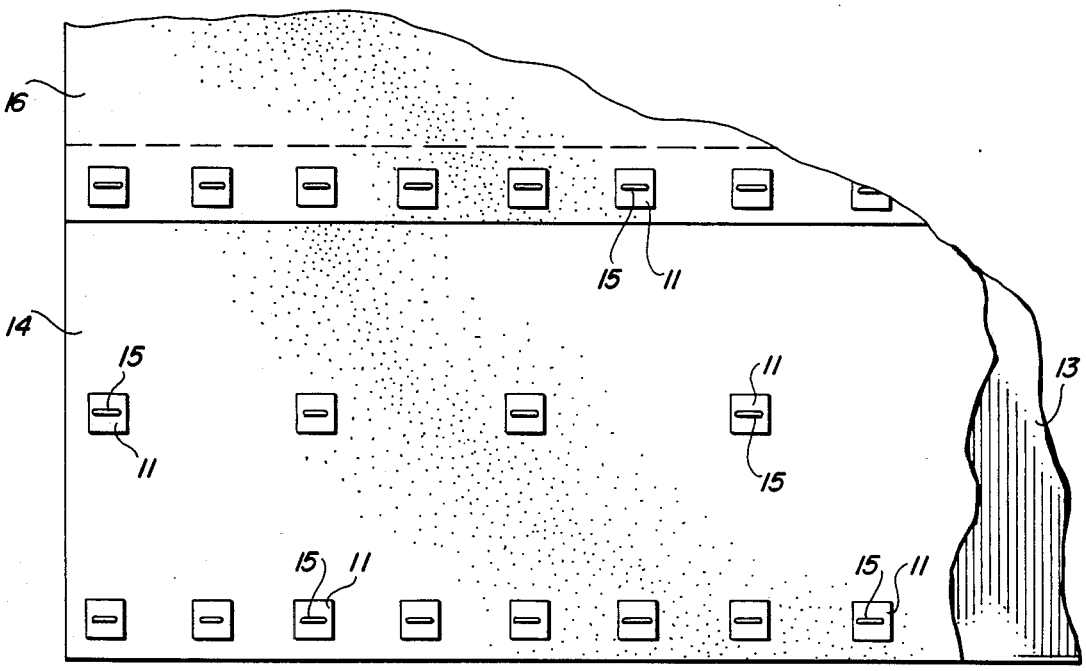
FIG. 3 is a plan view partially broken away of a corner of a roof showing two overlapping strips of roofing paper stapled to an underlying plywood panel using our roofing tabs.

Referring now to FIGS. 3 and 4, the use of our roofing tabs will be explained. Builder's felt roofing paper conventionally is supplied in rolls 36 inches wide. The plywood panels nailed to the roof trusses are covered with horizontally laid strips of roofing paper beginning with the lowermost horizontal edge of the roof.

FIG. 3 shows a corner of roof consisting of plywood panel 13 covered with horizontally laid strips 14 and 16 of roofing paper. The upper edge of strip 14 (shown as a dotted line) is overlapped two inches by the lower edge of strip 16.

The lower edge of strip 14 is fastened to panel 13 by a row of staples 15 spaced six inches apart. Before each staple is driven into place, one of our perforated styrene reinforcing tabs 11 is placed on the roofing paper strip 14. Then staple 15 is driven through tab 11 and roofing paper 14 and into plywood panel 13 as best shown in FIG. 4.

To insure the fastening of the strips of roofing paper to the plywood panels, a second row of tabs 11 and staples 15 spaced 12 inches apart are laid across the center of strip 14 and another row of tabs and staples spaced six inches apart is laid along the upper edge of strip 14 overlapped by the lower edge of strip 16.

Being made of a plastic material, preferably styrene, our reinforcing tabs do not rust or deteriorate due to exposure to intense sunlight, rain or ice as do conventional metal discs. Since the staples used in roofing vary from $\frac{5}{8}$ths to 1 inch across, our $1\frac{1}{4}'' \times 1\frac{1}{4}''$ tabs are large enough for use with all commonly used staples and provide sufficient reinforcing area over the roofing paper to insure that the paper will not tear away from the underlying panel even in a high wind.

The plastic tabs should be at least 0.02 inches and preferably 0.03 inches in thickness so that a staple will not cut through the tab as it is driven through the roofing paper and into the plywood panel.

While we have shown and described a preferred embodiment of our invention, the invention is limited only by the scope and spirit of the appended claims.

We claim:

1. A method of securely fastening a strip of roofing paper onto a building panel in which a reinforcing tab is placed over the roofing paper before each staple or nail is driven through the reinforcing tab and roofing paper and into the building panel wherein the reinforcing tab is taken from a continuous roll of perforated tabs each consisting of a square of solid plastic material approximately $1\frac{1}{4}$ inches wide and 0.03 inches thick.

2. A method as set forth in claim 1 wherein the reinforcing tabs are made entirely of solid styrene.

* * * * *